US009341094B2

(12) United States Patent
Zhang et al.

(10) Patent No.: US 9,341,094 B2
(45) Date of Patent: May 17, 2016

(54) MUFFLER ASSEMBLY WITH SIPHON TUBE

(75) Inventors: Christina Zhang, Shanghai (CN); Bert Mohlmann, Mainz (DE); Wenshui Wang, Shanghai (CN); Charu S. Hayes, Huntington Woods, MI (US); Qiu Er Chen, Shanghai (CN)

(73) Assignee: GM Global Technology Operations LLC, Detroit, MI (US)

( * ) Notice: Subject to any disclaimer, the term of this patent is extended or adjusted under 35 U.S.C. 154(b) by 344 days.

(21) Appl. No.: 13/591,270

(22) Filed: Aug. 22, 2012

(65) Prior Publication Data

US 2014/0054101 A1 Feb. 27, 2014

(51) Int. Cl.
*F01N 1/02* (2006.01)
*F01N 1/08* (2006.01)

(52) U.S. Cl.
CPC *F01N 1/02* (2013.01); *F01N 1/083* (2013.01); *F01N 2240/22* (2013.01); *F01N 2470/30* (2013.01); *F01N 2490/08* (2013.01)

(58) Field of Classification Search
CPC ..... F01N 3/005
USPC ..... 181/244, 237
See application file for complete search history.

(56) References Cited

U.S. PATENT DOCUMENTS

| | | | | | |
|---|---|---|---|---|---|
| 2,084,435 | A | * | 6/1937 | Deremer | 181/244 |
| 2,921,432 | A | * | 1/1960 | Marcotte et al. | 55/307 |
| 4,259,928 | A | | 4/1981 | Huber | |
| 4,393,956 | A | * | 7/1983 | Tsukui et al. | 181/265 |
| 4,402,714 | A | | 9/1983 | Fethke et al. | |
| 4,655,035 | A | | 4/1987 | Sager, Jr. | |
| 4,865,154 | A | | 9/1989 | Hanson et al. | |
| 5,025,890 | A | * | 6/1991 | Hisashige et al. | 181/272 |
| 5,154,204 | A | | 10/1992 | Hatzikazakis | |
| 5,563,383 | A | * | 10/1996 | Harwood | 181/282 |
| 5,563,385 | A | * | 10/1996 | Harwood | 181/282 |
| 5,573,395 | A | | 11/1996 | Althaus et al. | |
| 5,962,822 | A | | 10/1999 | May | |
| 7,896,130 | B2 | | 3/2011 | Hill et al. | |
| 2007/0080020 | A1 | | 4/2007 | Emmett | |
| 2011/0120103 | A1 | | 5/2011 | Lee et al. | |
| 2012/0073275 | A1 | | 3/2012 | Han et al. | |

FOREIGN PATENT DOCUMENTS

| | | | | |
|---|---|---|---|---|
| CN | 201262110 | Y | 6/2009 | |
| CN | 201310402 | Y | 9/2009 | |
| CN | 201329801 | Y | 10/2009 | |
| CN | 201386583 | Y | 1/2010 | |
| CN | 201401221 | Y | 2/2010 | |
| CN | 102418582 | A | 4/2012 | |
| DE | 4235625 | A1 * | 4/1994 | F01N 1/084 |

(Continued)

*Primary Examiner* — Jeremy Luks
(74) *Attorney, Agent, or Firm* — Quinn Law Group, PLLC

(57) ABSTRACT

A muffler assembly for a vehicle includes a housing at least partially defining an internal cavity and having an inlet and an outlet. The muffler assembly includes an outlet pipe that has an inlet end open to the internal cavity and an outlet end open at the outlet of the housing. A siphon tube is in the internal cavity and has an inlet opening adjacent an inner surface of the housing and an outlet opening in fluid communication with the outlet pipe between the inlet end and the outlet end of the outlet pipe. The siphon tube is configured to remove condensate from the internal cavity when a predetermined pressure differential is established between the inlet opening and the outlet opening.

20 Claims, 4 Drawing Sheets

(56) References Cited

FOREIGN PATENT DOCUMENTS

| | | | |
|---|---|---|---|
| JP | 2004316478 | A | 11/2004 |
| JP | 2008144734 | A | 6/2008 |
| KR | 20020045377 | A | 6/2002 |
| KR | 20040051628 | A | 6/2004 |
| KR | 20040059519 | A | 7/2004 |
| KR | 20050015850 | A | 2/2005 |
| KR | 20070079741 | A | 8/2007 |
| KR | 20080021982 | A | 3/2008 |
| KR | 20080028137 | A | 3/2008 |
| WO | 2011158996 | A1 | 12/2011 |

* cited by examiner

MUFFLER ASSEMBLY WITH SIPHON TUBE

TECHNICAL FIELD

The present teachings generally include a muffler assembly for a vehicle.

BACKGROUND

A muffler assembly is typically used in a vehicle exhaust system to lessen noise associated with exhaust gas travelling from the engine. A muffler assembly has a housing through which the exhaust gas travels from an inlet to an outlet. Condensate from the exhaust gas tends to collect inside the housing. The condensate can corrode the housing if it is not expelled. Efforts to expel the condensate have included placing a drain hole at the bottom of the housing. This can cause increased noise. Additionally, condensate can leak through the drain hole when the vehicle is parked, discoloring a parking area. Alternatively, the housing can be made of a more corrosion-resistant material, but this may add weight or cost. Expulsion systems with valves or jet pumps can be complex in design, adding to cost.

SUMMARY

A muffler assembly for a vehicle includes a housing at least partially defining an internal cavity and having an inlet and an outlet. The muffler assembly includes an outlet pipe that has an inlet end open to the internal cavity and an outlet end open at the outlet of the housing. A siphon tube is in the internal cavity and has an inlet opening adjacent an inner surface of the housing and an outlet opening in fluid communication with the outlet pipe between the inlet end and the outlet end of the outlet pipe. The siphon tube is configured to remove condensate from the internal cavity when a predetermined pressure differential is established between the inlet opening and the outlet opening. The predetermined pressure differential will be achieved when the muffler assembly is installed on a vehicle, and the vehicle is travelling at or above a predetermined speed. Thus, condensate is expelled during vehicle travel. This may be an improvement over systems in which condensate is expelled when the vehicle is parked.

In one embodiment, the siphon tube is secured to the outlet pipe, such as by welding. In another embodiment, the siphon tube is secured to a baffle that extends in the internal cavity, such as by welding the siphon tube to the baffle. By securing the siphon tube, noise within the muffler assembly may be reduced. The muffler assembly may have a housing configured with a depression adjacent an inlet opening of the siphon tube. Condensate collects in the depression just below the inlet opening of the siphon tube, aiding in the ability of the siphon tube to exhaust the condensate.

In one embodiment, the outlet pipe of the muffler assembly has a narrowed portion, and the siphon tube is in fluid communication with the outlet pipe at the narrowed portion. The narrowed portion tends to increase velocity of the exhaust gas traveling through the outlet pipe, thus increasing the pressure differential across the siphon tube and promoting siphoning of condensate through the tube.

By promoting condensate expulsion, the muffler assembly should be quieter, and less subject to corrosion, therefore with a potentially longer useful life than known muffler assemblies. Increased drainage of condensate may be achieved due to the siphon tube and an optional depression in the housing adjacent an inlet opening of the siphon tube. The muffler assembly may be lower in cost than muffler assemblies that use a jet pump or a pressure valve to expel condensate. The muffler assembly with the siphon tube may be quieter in operation than a design that has a drain hole through the muffler housing for condensate drainage. Such a drain hole may also increase in size over time due to corrosion, further exacerbating noise issues. The muffler assembly avoids the increased cost likely with a thicker or different muffler housing material that may be required for some condensate expulsion systems. With a depression provided in the housing, the muffler assembly may achieve complete condensate expulsion, in contrast to a design that relies on bending of the outlet pipe with a drain hole at the bottom of the bend to drain condensate, as such a design will likely have some residual condensate.

The above features and advantages and other features and advantages of the present teachings are readily apparent from the following detailed description of the best modes for carrying out the present teachings when taken in connection with the accompanying drawings.

DETAILED DESCRIPTION

Figure 1:
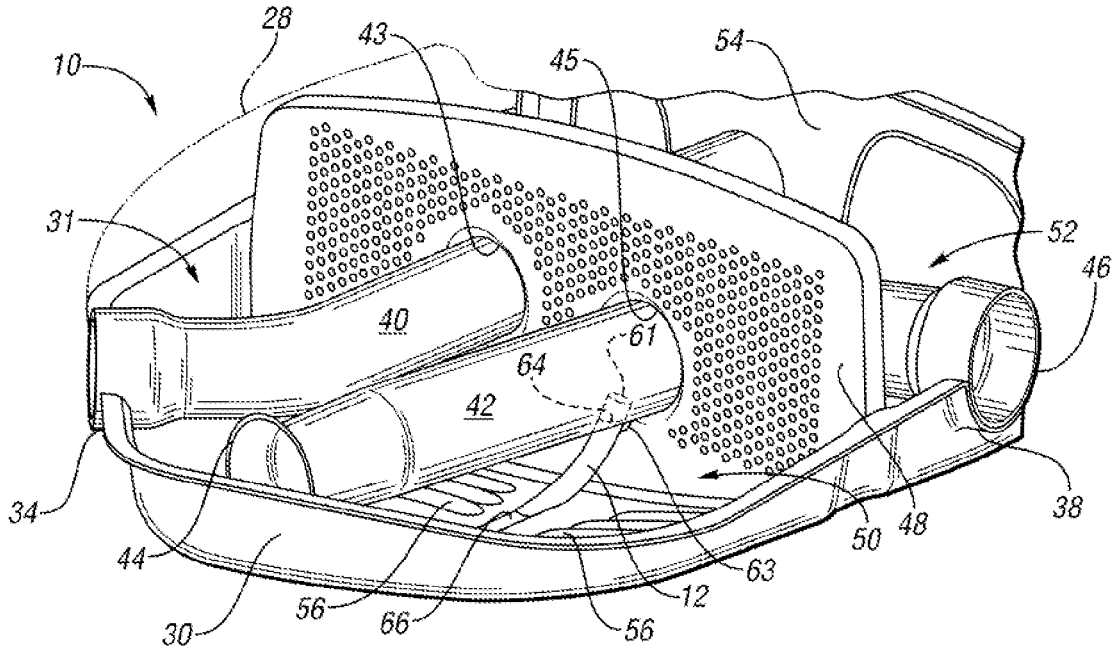
FIG. 1 is a schematic perspective illustration in fragmentary view of a muffler assembly in accordance with one aspect of the present teachings with a top portion of a muffler housing shown in phantom.

Referring to the drawings, wherein like reference numbers refer to like components throughout the several views, FIG. 1 shows a muffler assembly 10 that has a siphon tube 12 specifically designed to remove condensate from the muffler assembly 10 as further described herein. Specifically, the muffler assembly 10 is designed so that the condensate collects below the siphon tube 12, and is discharged from the muffler assembly 10 through the siphon tube 12 when a pressure differential across the siphon tube 12 reaches a predetermined level.

Figure 5:
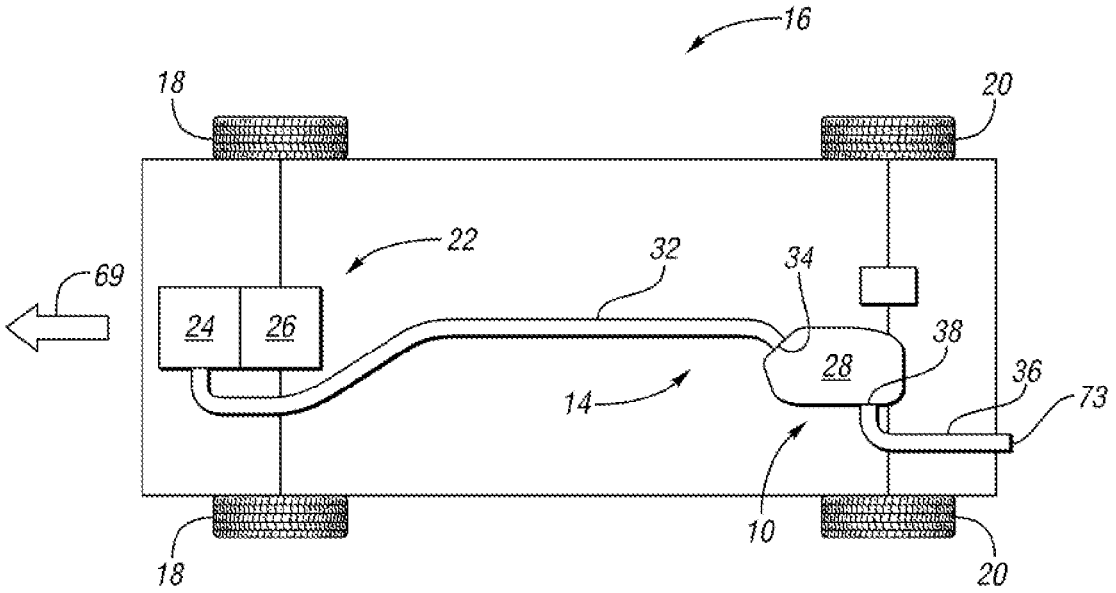
FIG. 5 is a schematic illustration of a vehicle with an exhaust system that includes the muffler assembly of FIG. 1.

The muffler assembly 10 is part of an exhaust system 14 of a vehicle 16, as shown in FIG. 5. The vehicle 16 has front wheels 18 and rear wheels 20. A powertrain 22 includes an engine 24 operatively connected to the front wheels 18 through a transmission 26 for propelling the vehicle. The exhaust system 14 extends from the engine 24 to treat engine exhaust prior to discharging the exhaust to the atmosphere. One or more exhaust treatment components, not shown, may be included in the exhaust system 14. For example, the exhaust system 14 may include a catalytic converter, an exhaust gas recirculation system, and, in the case of a diesel engine, a diesel oxidation catalyst and a diesel particulate filter. FIG. 5 shows the muffler assembly 10 from above so that a top housing portion 28 is visible. The top housing portion 28 fits to a bottom housing portion 30 shown in FIG. 1 and may be welded or otherwise secured thereto in a clam shell arrangement. Together, the top housing portion 28 and the bottom housing portion 30 form a housing that defines an internal cavity 31. An exhaust pipe 32 extends from the engine 24 to an inlet 34 of the muffler assembly 10, and a tailpipe 36 extends from an outlet 38 of the muffler assembly 10. The additional exhaust treatment components discussed above may be in fluid communication with the exhaust pipe 32 between the engine 24 and the muffler assembly 10.

The muffler assembly 10 includes an inlet pipe 40 and an outlet pipe 42 both within the internal cavity 31. The inlet pipe 40 opens at the inlet 34 and introduces exhaust gas to the internal cavity 31. The outlet pipe 42 has an inlet end 44 that is open to the internal cavity 31 and an outlet end 46 at the outlet 38 that is not open to the internal cavity 31. The outlet end 46 feeds to the tailpipe 36 of FIG. 5. As is understood by those skilled in the art, the muffler assembly 10 quiets noise in the exhaust by forcing the exhaust to travel through the inlet pipe 40 and the outlet pipe 42 within the cavity 31. A first baffle 48 divides the cavity 31 into a first subchamber 50 and a second subchamber 52. Both the inlet pipe 40 and the outlet pipe 42 are partially supported by the first baffle 48 and pass through respective openings 43, 45 in the baffle 48. The inlet end 44 of the outlet pipe 42 is in the first subchamber 50. The outlet end 46 of the outlet pipe 42 extends out of the second subchamber 52 at the outlet 38. A second baffle 54 further separates the cavity 31. The baffles 48, 54 are perforated, permitting exhaust to pass between the subchambers 50, 52 at a controlled rate. Ridges 56 extend into the cavity 31 from an inner surface 58 of the bottom housing portion 30, and are designed to reduce noise of the exhaust gas. The controlled passage of the exhaust gas through the cavity 31 from the inlet pipe 40 to the outlet end 46 of the outlet pipe 42 reduces noise, as is understood by those skilled in the art.

Figure 2:
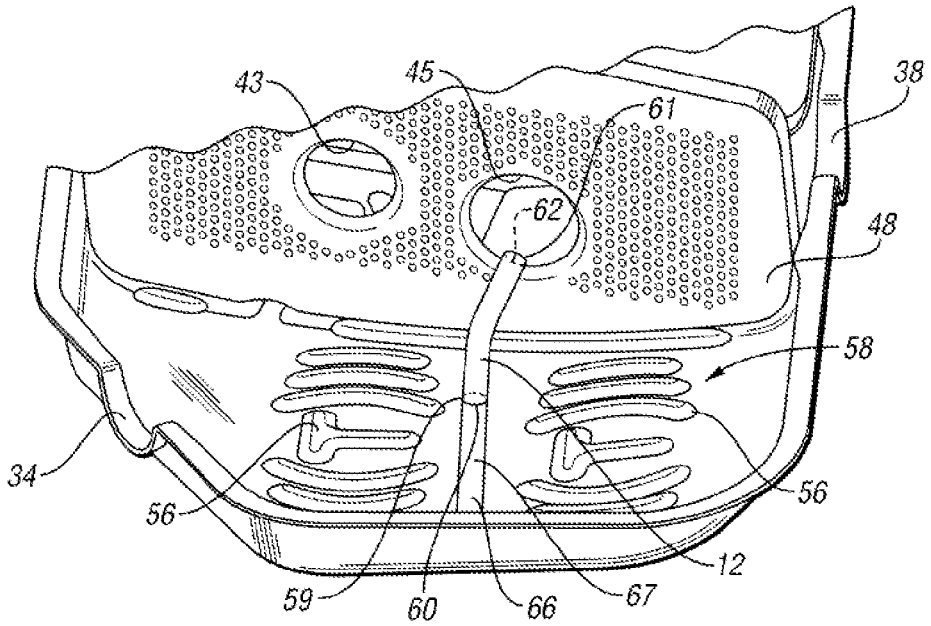
FIG. 2 is a schematic perspective illustration in fragmentary view of the muffler assembly of FIG. 1.

In FIG. 2, the inlet pipe 40 and the outlet pipe 42 are removed for clarity, in order to show the siphon tube 12 has a first end 59 with an inlet opening 60 and a second end 61 with an outlet opening 62, shown in hidden lines. The siphon tube 12 is welded to the outlet pipe 42 at the outlet opening as indicated by a weld area 63. The siphon tube 12 is curved between the inlet opening 60 and the outlet opening 62. The outlet pipe 42 has an opening 64 through which the second end 61 extends so that the outlet opening 62 empties into the outlet pipe 42. Accordingly, the internal cavity 31 is in fluid communication with the atmosphere through the siphon tube 12, the outlet pipe 42, and the tailpipe 36 of FIG. 5.

Figure 7:
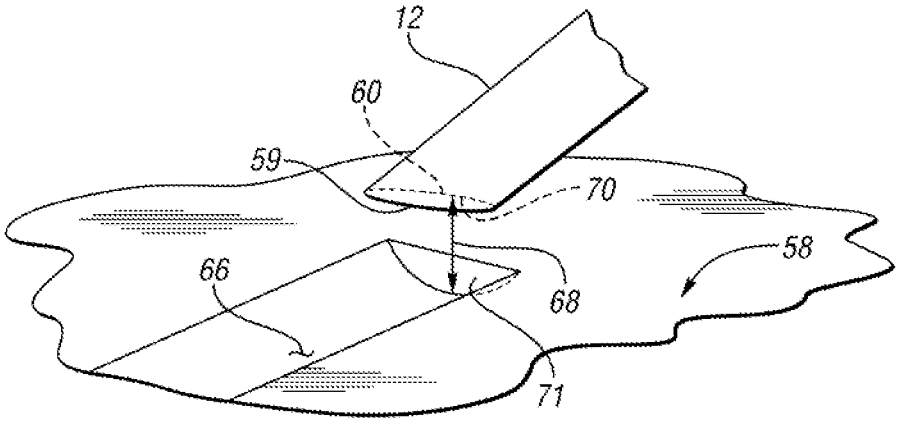
FIG. 7 is a schematic illustration in fragmentary perspective view of the muffler assembly of FIG. 1 showing a siphon tube above a depression of the housing portion.

The first end 59 of the siphon tube 12 is cut at an angle so that the inlet opening 60 has a slightly oval shape. The tube 12 is cut so that the inlet opening 60 is angled downward toward the inner surface 58. The angular cut thus provides a larger inlet opening 60 for pickup of condensate than if the opening was circular. The inlet opening 60 is positioned above a depression 66 formed in the inner surface 58 of the bottom housing portion 30. The depression 66 is an elongated groove 67 with a U-shape in cross-section that establishes a deepest portion of the internal cavity 31. Accordingly, exhaust gas condensate that forms within the internal cavity 31 eventually settles in the depression 66 due to gravity. In other words, the depression 66 is configured to collect the condensate because it is the deepest, i.e., the lowest, area of the housing portion 30 that partially defines the cavity 31. The inlet opening 60 of the siphon tube 12 is positioned at a predetermined clearance 68 above the inner surface 58 at the depression 66, as best shown in FIG. 7. The elongated groove 67 has a terminal end 71 just below the inlet end 60 of the siphon tube 12. The predetermined clearance 68 extends from the inner surface 58 at the lowest point of the depression 66 to the lowest extremity 70 of the inlet opening 60 of the siphon tube 12. The clearance 68 may be but is not limited to 3 millimeters.

With the muffler assembly 10 configured as described, a pressure differential will be established between the inlet opening 60 and the outlet opening 62 of the siphon tube 12. The pressure differential occurs because the vehicle 16 moves forward in the direction of arrow 69 in FIG. 5, in an opposite direction as an open end 73 of the tailpipe 36. Forward movement of the vehicle 16 creates a vacuum at the open end 73. Because the outlet opening 62 of the siphon tube 12 is in fluid communication with the open end 73 of the tailpipe 36 through the outlet pipe 42, the vacuum is carried through to the inlet opening 60 of the tube 12. When the vehicle 10 travels above a predetermined speed, a predetermined pressure differential will exist from the inlet opening 60 of the tube 12 just above the depression 66, to the outlet opening 62. This pressure differential is sufficient to create siphoning of the condensate that gathers in the depression 66. The condensate collected in the depression 66 is thus pulled through the siphon tube 12 and out of the muffler assembly 10 to be expelled out of the tailpipe 36. Condensate is thus continuously collected in the depression 66 and passively expelled through the siphon tube 12 when the vehicle 16 is operated. Only gravity and forward travel of the vehicle 16 are required to expel the condensate. No actuators are required.

Figure 3:
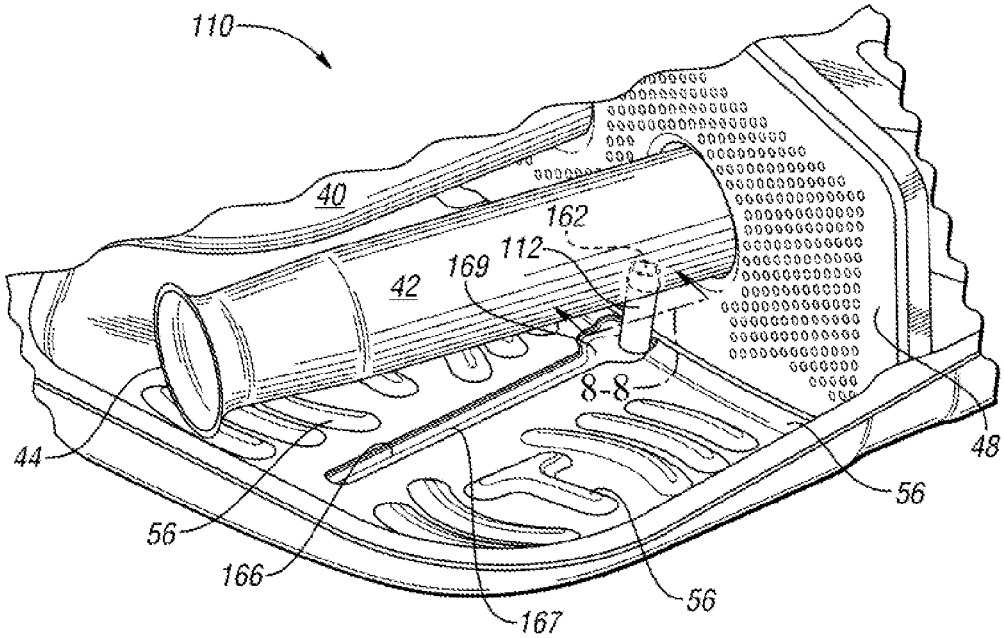
FIG. 3 is a schematic illustration in fragmentary perspective view of a muffler assembly in accordance with an alternative aspect of the present teachings.
Figure 4:
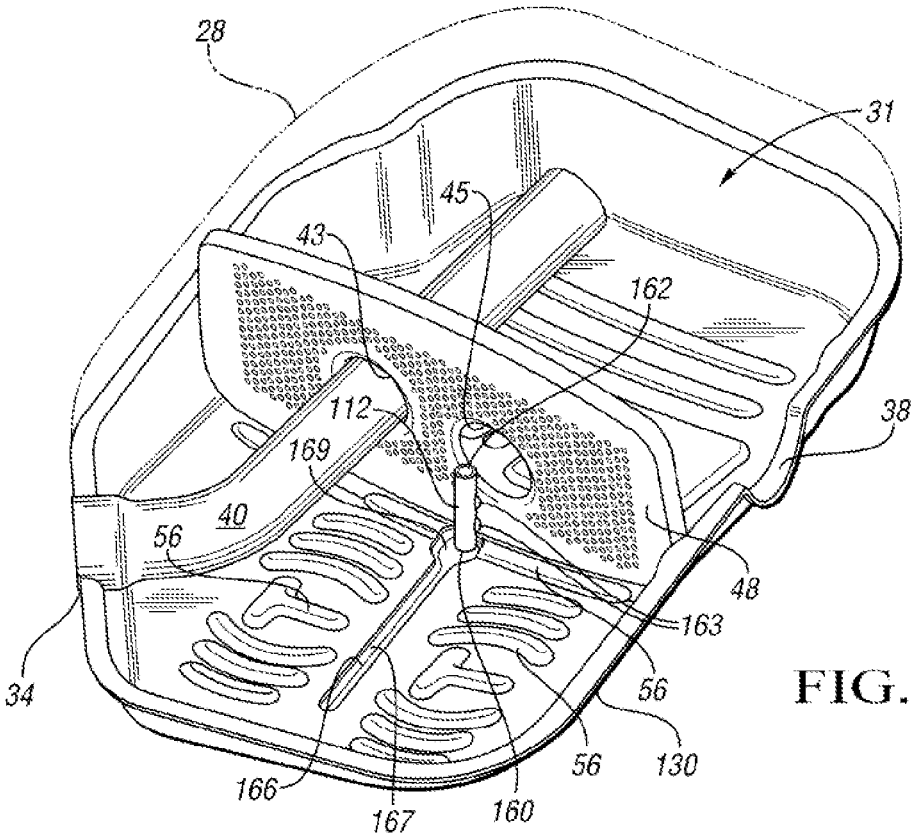
FIG. 4 is a schematic perspective illustration of the muffler assembly of FIG. 3 with a top portion of a muffler housing shown in phantom.
Figure 8:
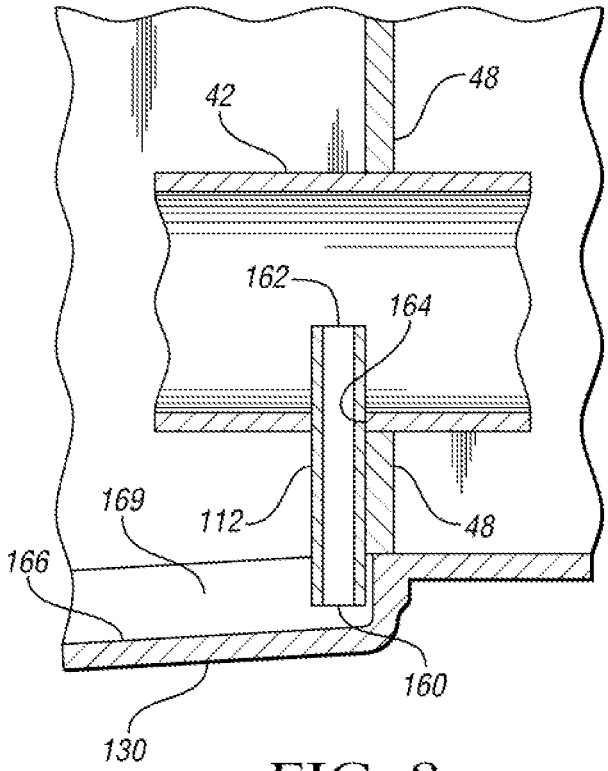
FIG. 8 is a schematic illustration in fragmentary cross-sectional view of the muffler assembly of FIGS. 3 and 4 taken at the lines 8-8 in FIG. 3.

FIGS. 3 and 4 show another embodiment of a muffler assembly 110 that can be used in place of the the muffler assembly 10 in the vehicle 16 of FIG. 1. The muffler assembly 110 has many of the same components functioning in the same manner as described with respect to the muffler assembly 10 of FIG. 1, and such components are indicated with the same reference numbers as used in FIG. 1. In FIG. 4, both the second baffle 54 and the outlet pipe 42 are removed for purposes of clarity. A siphon tube 112 is welded or otherwise secured to the baffle 48 as indicated by welds 163 and extends substantially straight and parallel with the baffle 48 from an inlet opening 160 to an outlet opening 162. Securing the tube 112 to the baffle 48 helps to reduce noise in the muffler assembly 110. As best shown in FIG. 8, the siphon tube 112 extends through the opening 64 in the outlet pipe 42 so that the siphon tube 112 is in fluid communication with the outlet pipe 42 and, more specifically, the internal cavity 31 is in fluid communication with the atmosphere through the siphon tube 112 and outlet pipe 42.

In the embodiment of FIGS. 3, 4 and 8, a depression 166 is formed in the bottom housing portion 130 and has an elongated groove 167 as well as an enlarged terminal portion 169 adjacent the inlet opening 60. The enlarged terminal portion 169 is at least as deep as or slightly deeper than the elongated groove 167 and together the depression 166 is the deepest portion of the cavity 31.

When the vehicle 16 travels above a predetermined speed, a predetermined pressure differential will exist from the inlet opening 160 of the tube 112 just above the depression 166, to the outlet opening 162. This pressure differential is sufficient to create siphoning of the condensate that gathers in the depression 166. The condensate collected in the depression 166 is thus pulled through the siphon tube 112 and out of the muffler assembly 110 to be expelled out of the tailpipe 36 of FIG. 1. Condensate is thus continuously collected in the depression 166 and passively expelled through the siphon tube 112 when the vehicle 16 is operated. Only gravity and forward travel of the vehicle 16 are required to expel the condensate. No actuators are required.

Figure 6:
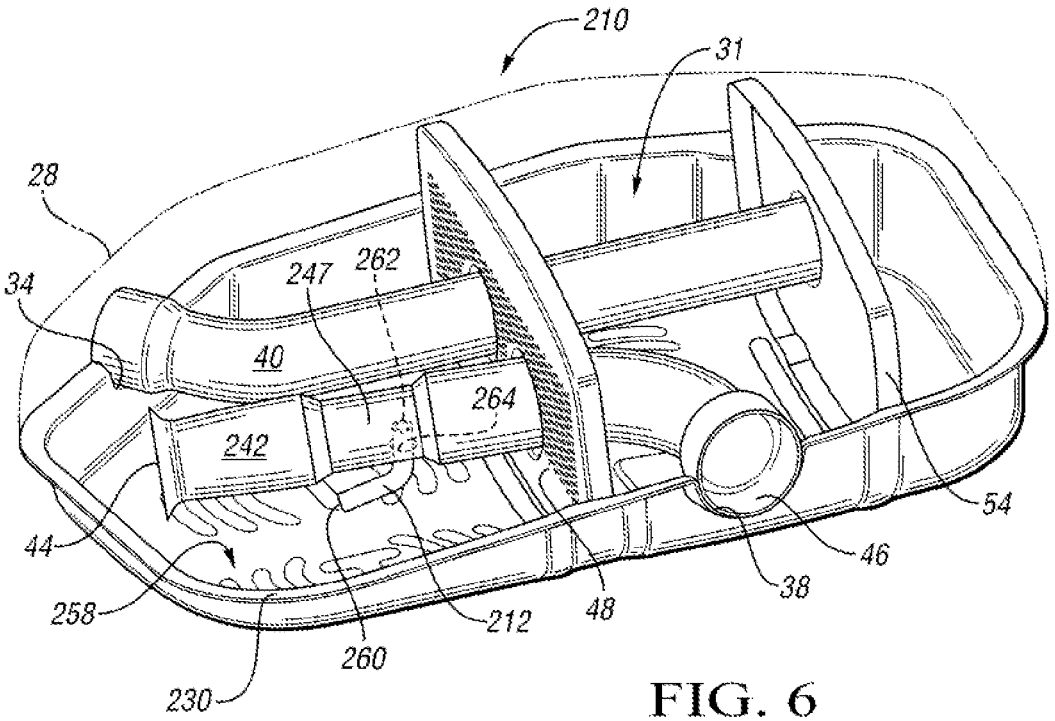
FIG. 6 is a schematic illustration in perspective view of a muffler assembly in accordance with another alternative aspect of the present teachings with a top portion of a muffler housing shown in phantom.

FIG. 6 shows a third embodiment of a muffler assembly 210 that can be used in the vehicle 16 of FIG. 1 in place of the muffler assembly 10. The muffler assembly 210 has a housing with a top housing portion 28 shown in phantom and a bottom housing portion 230 defining the internal cavity 31.

The muffler assembly 210 has an outlet pipe 242 configured with a narrowed section 247 between the inlet end 44 and the outlet end 46. A siphon tube 212 extends from an inner surface 258 of the bottom housing portion 230 through an opening 264 in the outlet pipe 242 at the narrowed section 247. The siphon tube 212 is substantially L-shaped, and siphons condensate collected at the inner surface 258 from an inlet opening 260 to an outlet opening 262 that is within the outlet pipe 242. Although not shown, the bottom housing portion 230 may have a depression, like depression 66 or 166 of FIGS. 1 and 3, adjacent the inlet opening 260 to collect condensate just below the inlet opening 260.

When the vehicle 16 travels above a predetermined speed, a predetermined pressure differential will exist from the inlet opening 260 of the tube 212 just above the inner surface 258, to the outlet opening 262. This pressure differential is sufficient to create siphoning of the condensate that gathers at the inner surface 258. The condensate collected through the inlet opening 260 is thus pulled through the siphon tube 212 and out of the muffler assembly 210 to be expelled out of the tailpipe 36 of FIG. 5. Condensate is thus continuously collected and passively expelled through the siphon tube 212 when the vehicle 16 is operated. Only gravity and forward travel of the vehicle 16 are required to expel the condensate. No actuators are required. Exhaust gas passing through the outlet pipe 242 has an increased velocity at the narrowed section 247. This decreases the pressure at the outlet opening 262, creating a greater pressure differential from the inlet opening 260 to the outlet opening 262 to promote expelling of the condensate.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. A muffler assembly for a vehicle comprising:

a housing at least partially defining an internal cavity and having an inlet and an outlet;

an outlet pipe having an inlet end open to the internal cavity and an outlet end open at the outlet;

a baffle separating the internal cavity into a first subchamber and a second subchamber; wherein the outlet pipe extends through the baffle such that the outlet pipe is in both the first subchamber and the second subchamber, and the inlet end is in the first subchamber; wherein the baffle has perforations configured so that exhaust passes through each of the perforations from the first subchamber directly to the second subchamber at a controlled rate;

a siphon tube in the internal cavity having an inlet opening adjacent an inner surface of the housing and an outlet opening in fluid communication with the outlet pipe between the inlet end and the outlet end of the outlet pipe; wherein the inlet opening of the siphon tube is in the first subchamber; wherein the outlet opening of the siphon tube is in a portion of the outlet pipe in the first subchamber, upstream of the baffle; and wherein the siphon tube is configured to remove condensate from the internal cavity when a predetermined pressure differential is established between the inlet opening and the outlet opening.

2. The muffler assembly of claim 1, wherein the siphon tube is secured to the outlet pipe.

3. The muffler assembly of claim 1, wherein the siphon tube is secured to the baffle.

4. The muffler assembly of claim 3, wherein the housing has a depression; and wherein the inlet opening of the siphon tube is at least partially in the depression.

5. The muffler assembly of claim 4, wherein the depression is an elongated groove defining a deepest portion of the internal cavity.

6. The muffler assembly of claim 5, wherein the siphon tube is straight and extends from the elongated groove substantially parallel with the baffle.

7. The muffler assembly of claim 6, wherein the groove has an enlarged terminal portion adjacent the inlet opening of the siphon tube.

8. The muffler assembly of claim 4, wherein the siphon tube is curved between the inlet opening and the outlet opening.

9. The muffler assembly of claim 8, wherein the inlet opening of the siphon tube has an oval shape.

10. The muffler assembly of claim 1, wherein the outlet pipe has a narrowed section; and wherein the siphon tube is in fluid communication with and opens into the narrowed section of the outlet pipe.

11. The muffler assembly of claim 1, wherein the baffle is a first baffle, and further comprising:

a second baffle further separating the internal cavity to include a third subchamber; and wherein the outlet of the housing is at the second subchamber.

12. The muffler assembly of claim 11, wherein the outlet pipe bends between the inlet and the outlet.

13. A muffler assembly for a vehicle comprising:

a housing at least partially defining an internal cavity and having an inlet and an outlet;

an outlet pipe having an inlet end open to the internal cavity and an outlet end open at the outlet; wherein the outlet pipe has a first section at the inlet end, a second section at the outlet end, and a narrowed section between the first section and the second section; wherein the narrowed section is narrower than both the first section and the second section;

a baffle separating the internal cavity into a first subchamber and a second subchamber; wherein the outlet pipe extends through the baffle such that outlet pipe is in both the first subchamber and the second subchamber; wherein the inlet end, the narrowed section, and the first section are in the first subchamber; wherein the baffle has perforations configured so that exhaust passes through each of the perforations from the first subchamber directly to the second subchamber at a controlled rate;

a siphon tube in the internal cavity having an inlet opening adjacent an inner surface of the housing in the first subchamber and an outlet opening in fluid communication with and opening into the narrowed section of the outlet pipe; wherein the siphon tube is curved between the inlet opening and the outlet opening; and wherein the siphon tube is configured to remove condensate from the internal cavity when a predetermined pressure differential is established between the inlet opening and the outlet opening.

14. The muffler assembly of claim 13, wherein the baffle is a first baffle, and further comprising:

a second baffle further separating the internal cavity to include a third subchamber.

15. The muffler assembly of claim 14, wherein the outlet of the housing is at the second subchamber.

16. The muffler assembly of claim 15, wherein the outlet pipe bends between the inlet and the outlet.

17. A muffler assembly for a vehicle comprising:

a housing at least partially defining an internal cavity and having an inlet and an outlet; wherein the housing has a bottom portion with an inner surface forming a depression;

an outlet pipe having an inlet end open to the internal cavity and an outlet end open at the outlet;

a siphon tube in the internal cavity having an angular cut forming an inlet opening with an oval shape adjacent an inner surface of the housing and an outlet opening in fluid communication with the outlet pipe between the inlet end and the outlet end of the outlet pipe;

wherein the siphon tube is configured to remove condensate from the internal cavity when a predetermined pressure differential is established between the inlet opening and the outlet opening;

wherein the inlet opening of the siphon tube is at a predetermined clearance above the inner surface at the depression;

a baffle separating the internal cavity into a first subchamber and a second subchamber; wherein the outlet pipe extends through the baffle such that outlet pipe is in both the first subchamber and the second subchamber, and the inlet end is in the first subchamber; wherein the baffle has perforations configured so that exhaust passes through each of the perforations from the first subchamber directly to the second subchamber at a controlled rate;

wherein the inlet opening of the siphon tube is in the first subchamber; and wherein the outlet opening of the siphon tube is in a portion of the outlet pipe in the first subchamber.

18. The muffler assembly of claim 17, wherein the siphon tube is secured to the outlet pipe.

19. The muffler assembly of claim 18, wherein the siphon tube is curved between the inlet opening and the outlet opening.

20. The muffler assembly of claim 17, wherein the outlet of the housing is at the second subchamber; and wherein the outlet pipe bends between the inlet and the outlet.

* * * * *